US007934303B2

(12) United States Patent
Awwad et al.

(10) Patent No.: US 7,934,303 B2
(45) Date of Patent: May 3, 2011

(54) METHOD OF REMANUFACTURING AND SALVAGING HYDRAULIC PUMPS

(75) Inventors: Usama Y. Awwad, Corinth, MS (US); Trent A. Simpson, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1238 days.

(21) Appl. No.: 11/148,829

(22) Filed: Jun. 9, 2005

(65) Prior Publication Data

US 2006/0280619 A1 Dec. 14, 2006

(51) Int. Cl.
*B23P 6/00* (2006.01)

(52) U.S. Cl. ..... 29/402.11; 29/402.04; 29/402.09; 29/402.17; 29/525.11; 29/888.021; 417/53

(58) Field of Classification Search ..... 29/402.01, 29/402.03, 402.04, 402.05, 402.06, 402.09, 29/402.11, 402.12, 402.13, 525, 525.11, 29/526.4, 888.02, 888.021, 402.17; 417/53, 417/269

See application file for complete search history.

(56) References Cited

U.S. PATENT DOCUMENTS

| | | | | |
|---|---|---|---|---|
| 4,215,624 | A * | 8/1980 | Tobias | 91/499 |
| 6,240,661 | B1 * | 6/2001 | Seibold | 37/395 |
| 6,435,788 | B2 * | 8/2002 | Reed | 411/178 |
| 2003/0154853 | A1 | 8/2003 | Thompson et al. | |

* cited by examiner

*Primary Examiner* — David P Bryant
*Assistant Examiner* — Sarang Afzali
(74) *Attorney, Agent, or Firm* — Finnegan, Henderson, Farabow, Garrett & Dunner LLP

(57) ABSTRACT

A hydraulic pump can be remanufactured to save the investment in its components that are not seriously worn or failed. Some of the worn components, such as the pump barrel and yoke, can be salvaged by replacing or rebuilding the worn features. In particular, a worn internal spline on the pump barrel can be replaced by a spline insert that is threaded to the pump barrel and includes a new internal spline. A worn actuation tab on a yoke for contacting an actuating piston can be replaced by adding a new tab wear button.

8 Claims, 9 Drawing Sheets

METHOD OF REMANUFACTURING AND SALVAGING HYDRAULIC PUMPS

FIELD OF THE INVENTION

The field of this invention is remanufacturing and salvaging, and more specifically the remanufacturing of hydraulic pumps, and hydraulic pumps amenable to remanufacturing.

BACKGROUND

Hydraulic pumps produce pressurized hydraulic fluid for many purposes. For example, on construction equipment and heavy machinery hydraulic pumps produce pressurized fluid which actuates implements such as shovels, works as a pilot fluid for operating hydraulic valves, and drives hydraulic motors for fans or propulsion. On engines, hydraulic pumps can also produce pressurized fluid for actuating fuel injectors and other purposes. As a result of these many uses, hydraulic pumps are a staple commodity for construction and other heavy equipment, diesel engines, and other machinery.

The principal components of these pumps may be made from parts that are cast, or begin as stock material, and are then machined extensively to create the features, such as bores, threaded connections, grooves for O-rings, seats for bearings, galleries, etc., that are part of most hydraulic pump designs. A significant investment can be made in manufacturing each of the various components for a pump.

After a certain amount of time in service, some of the components may experience wear and cause the pump to operate inefficiently or to fail.

While some components of a pump that has been in service may have worn or failed, other components may be in very good, even like-new condition. If a pump is removed from service and discarded, but only some of its components exhibit serious wear, the investment made in the remaining components that are not seriously worn will be lost.

Remanufacturing seeks, in part, to recuperate the investment in components that are not worn in machinery that is taken out of service. In remanufacturing, the part removed from service is called a core. Typically, the transaction of selling a remanufactured part to a customer also involves taking back a new core which itself will be remanufactured and sold to another customer. Thus, there is usually one core which enters the remanufacturer's operation for each remanufactured part that leaves. In the remanufacturer's operation, the cores are broken into their various components and cleaned and inspected. Seriously worn or failed components may be discarded and replaced with new, original components. The remanufactured part is returned to service with some new components, and some components that were in place during the part's prior service. The discarded parts can be recycled to reuse the metal or other base materials.

Besides saving non-worn parts and replacing only the worn parts, a remanufacturing operation can also seek to salvage the worn parts themselves to further increase efficiency and save costs. Salvaging involves performing various operations on the worn component to bring it back to its original specifications and functionality.

Because of the very common use of hydraulic pumps on construction and other machinery as described above, because these pumps can wear rapidly, and because of the cost savings which can be achieved through remanufacturing, there is a need for developing effective salvage techniques which can be applied to facilitate remanufacturing. Besides the salvage techniques themselves, these pumps could be designed originally in a manner which better facilitates remanufacturing.

SUMMARY OF THE INVENTION

A hydraulic pump may comprises a barrel which rotates around a rotational axis, a plurality of cylinders formed in the barrel, each cylinder having a longitudinal axis formed generally parallel to the rotational axis, a piston positioned inside of each of the plurality of cylinders for movement relative thereto, the pistons moving back and forth in their respective cylinders to pump hydraulic fluid, a central opening formed in the barrel generally parallel to the rotational axis, a separate, annular insert received in the central bore, and splines formed on an internal surface of the insert adapted for engaging corresponding external splines formed on a drive shaft.

A hydraulic pump may comprise a barrel which rotates around a rotational axis, a central bore formed in the barrel generally parallel to the rotational axis, and worn splines formed on an internal surface of the central bore adapted for engaging corresponding external splines formed on a drive shaft. A method of salvaging such a pump may comprise machining a new central bore in the barrel that substantially removes the worn splines, providing an insert, the insert having a second central bore having internal splines formed on an internal surface of the second central bore, the internal splines adapted for engaging external splines formed on a drive shaft, and inserting the insert into the new central bore.

A method of manufacturing and remanufacturing an axial piston hydraulic pump may comprise manufacturing an axial piston hydraulic pump having a barrel which rotates around a rotational axis, a central bore formed in the barrel generally parallel to the rotational axis, and splines formed on an internal surface of the central bore adapted for engaging external splines formed on a drive shaft. The method may further comprise placing the pump in service with an end user, receiving the pump back from an end user after it has been in service, and remanufacturing the pump. Remanufacturing the pump may comprise removing the splines formed on the internal surface of the central bore of the barrel, preparing an insert having a second central bore with new splines formed on an internal surface of the second central bore, the new splines adapted for engaging the external splines formed on a drive shaft, and inserting the insert into the central bore of the barrel.

DETAILED DESCRIPTION

The following is an exemplary description of the remanufacture of a hydraulic pump illustrating the principles of the invention. These details are not to be taken as a description of the invention's scope, but rather as specific examples provided to teach the broader principles of the invention.

Figure 1:
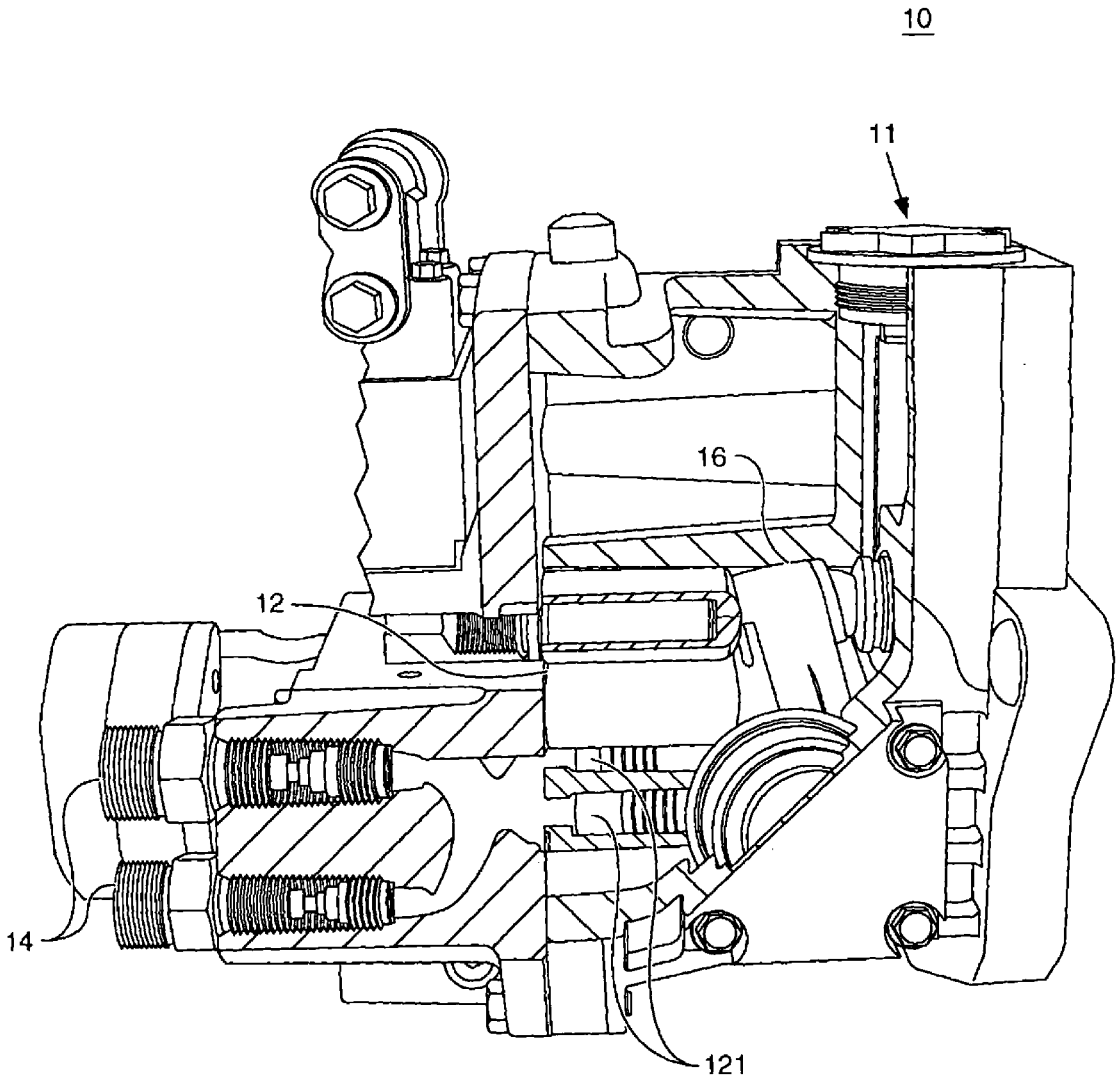
FIG. 1 is a partially cut-away, perspective view of an exemplary hydraulic pump.
Figure 2:
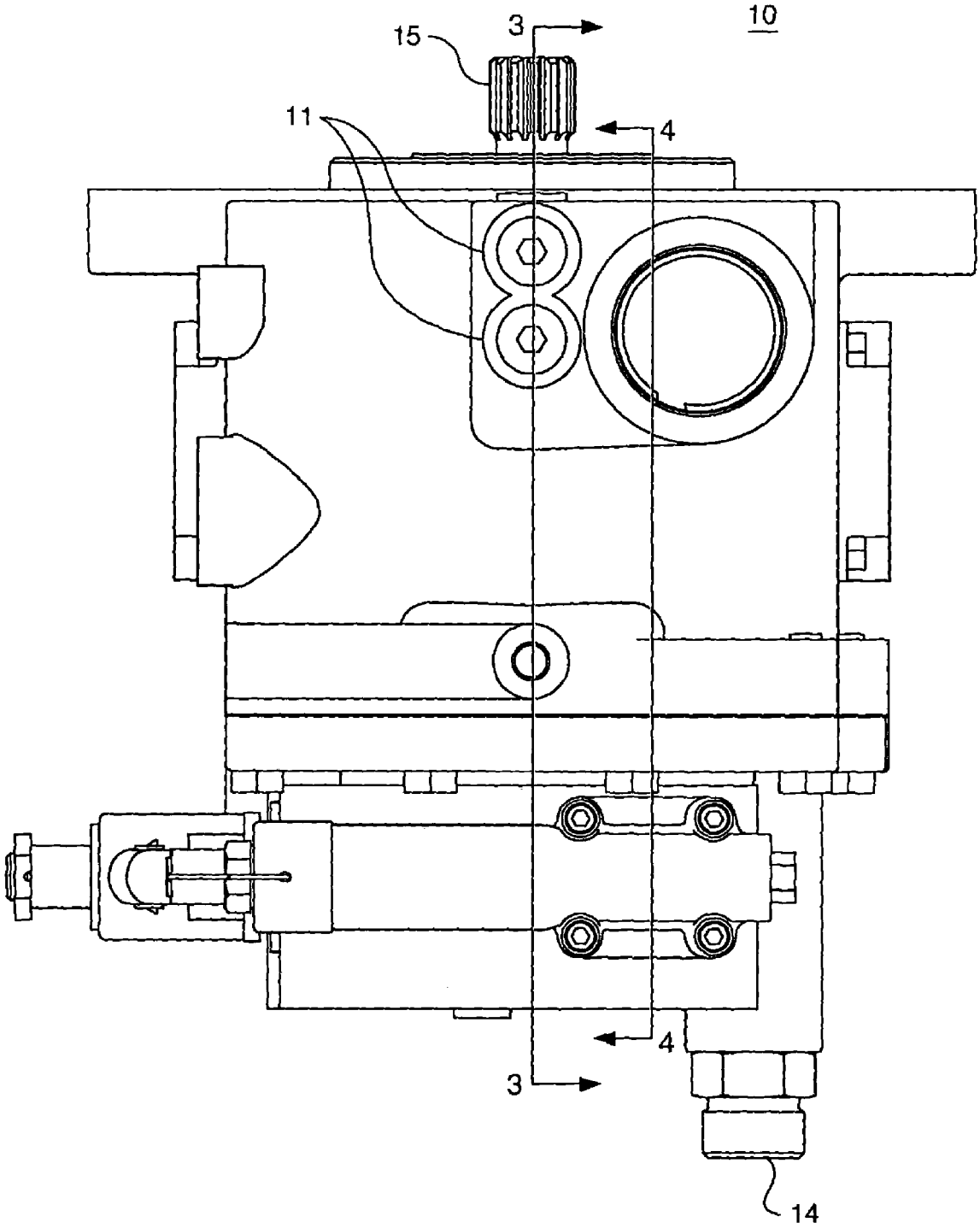
FIG. 2 is a top view of the pump of FIG. 1.
Figure 3:
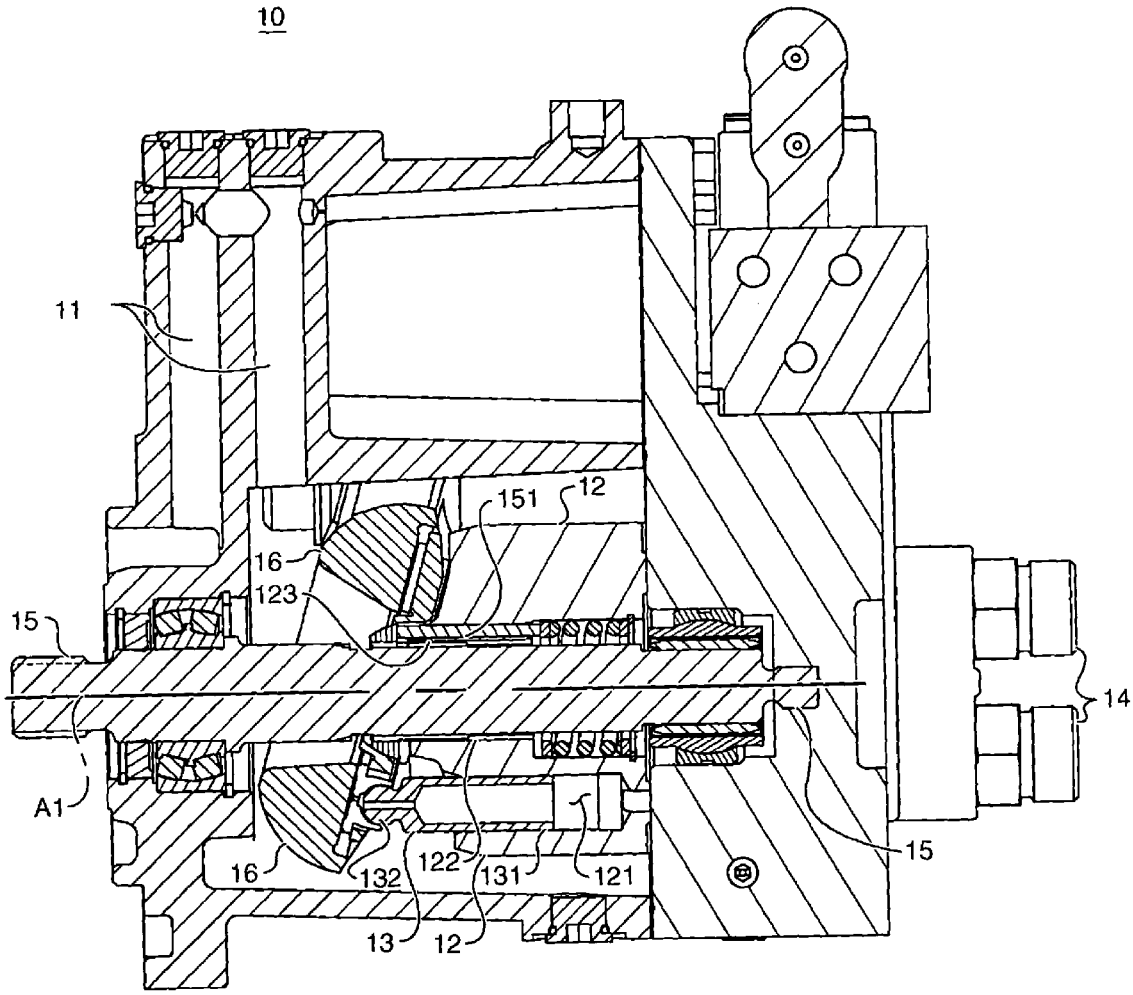
FIG. 3 is a sectional view of the pump of FIG. 1 taken along the cutting plane indicated in FIG. 2.
Figure 4:
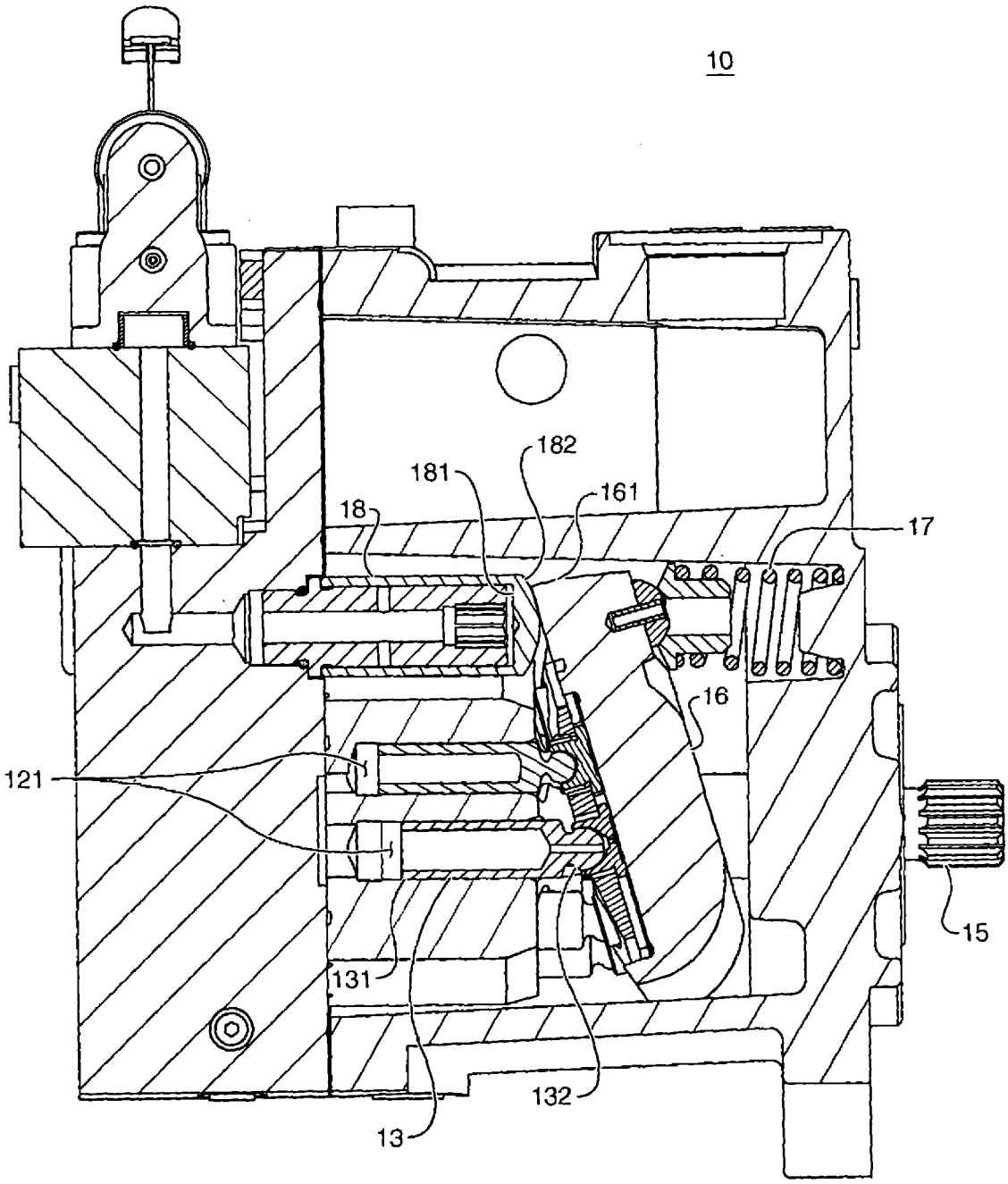
FIG. 4 is a sectional view of the pump of FIG. 1 taken along the cutting plane indicated in FIG. 2.

FIG. 1 shows a perspective view of an exemplary hydraulic pump 10 with a portion of the pump cut-away to show some of its internal components and features. FIGS. 2-4 also show views of pump 10 and some of its internal components. This commercially available pump for hydraulic actuation fluid for a hydraulic electronic unit injection (HEUI) engine fuel system is similar to many pumps known in the art pump. Not all the components of the pump 10 need be described herein as the pump and its function is known. Pump 10 is an example of an axial piston pump.

Fluid is supplied to the pump 10 from an inlet 11, drawn into the cylinders of a pump barrel 12, and pushed out of the pump barrel 12 under pressure by pistons 13. The pressurized fluid leaves the pump 10 at outlet 14.

Pump barrel 12 includes a plurality of cylinders 121. A piston 13 is received inside of each cylinder 121. A shaft 15 engages the pump barrel 12 at a central opening 122. The shaft 15 rotates the pump barrel 12 and its associated rotating group around an axis of rotation A1.

The pistons 13 move back and forth in the cylinders 121 and complete one complete pump cycle per revolution of the pump barrel 12. A first end 131 of the piston 13 pushes against the fluid to pressurize it during the latter half of the pump cycle. A second end 132 of the piston 13 is operatively associated with a yoke 16. Yoke 16 is pivotally mounted inside the pump. The yoke 16 pivots about a pivot axis A2 (see FIGS. 8 and 9) which is generally normal to the rotational axis Al of the pump barrel 12. In a manner known in the art for these type of variable displacement pumps, an assembly associated with and inclined at the same angle as the yoke 16 pushes against a piston 13 during the latter half of the pump cycle to force the piston 13 forward in the cylinder 121 and pump the fluid. The difference between a piston's 13 forward and rearward positions in the cylinder 121 during the pump cycle defines the pump's displacement and depends upon the angle of inclination of the yoke 16. When the yoke 16 is only slightly inclined, this difference is small and the displacement of the pump 10 is accordingly small. When the yoke 16 is more inclined, this difference is greater and the displacement is greater.

The power to rotate pump barrel 12 and its associated rotating group is transferred from shaft 15. Shaft 15 engages the pump barrel 12 through a spline arrangement. External splines 151 are formed on the shaft 15, and corresponding internal splines 123 are formed on the pump barrel 12. Splines are a convenient method for transferring power from the shaft 15 to the pump barrel 12 and are readily machined. However, the internal splines 123 on the pump barrel 12 can wear more rapidly than other parts of the pump barrel as a result of the tremendous concentration of stresses that can occur there.

Figure 8:
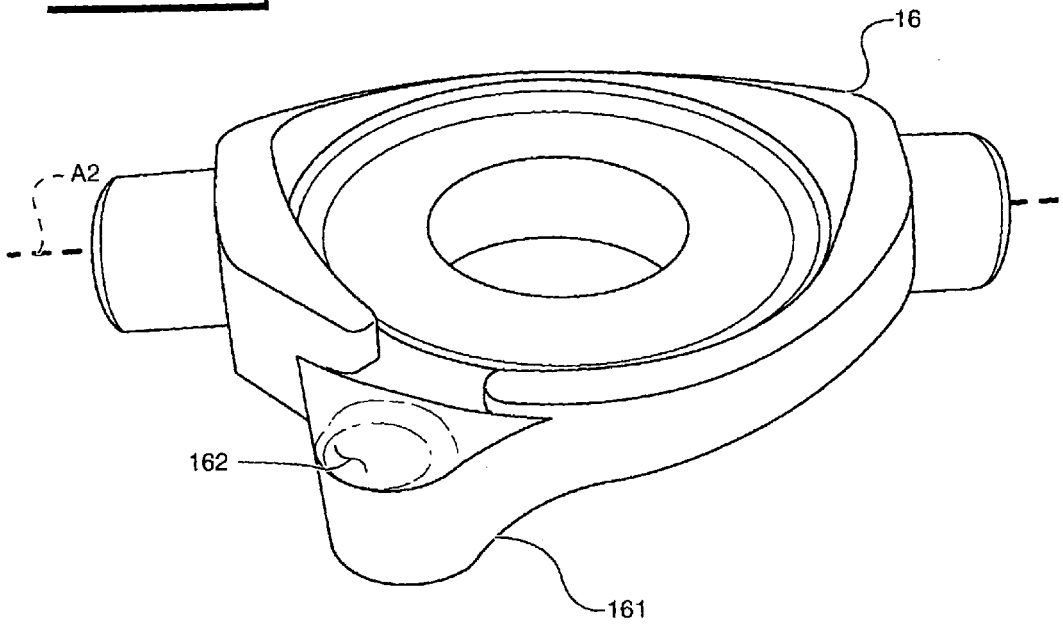
FIG. 8 is an isometric, sketch view of the yoke of the pump of FIG. 1 illustrating the tab of the yoke that contacts the actuating piston.

The inclination angle of the yoke 16 is adjusted by a control system of the pump 10 to correct the pump's displacement. A great amount of force is applied by the pistons 13 against the yoke 16. The yoke 16 is moved to and held at a particular inclination angle by a spring and ball joint assembly 17 on one side, and an actuation piston 18 on the other, as best seen in FIG. 4. To change the inclination angle, hydraulic fluid from a control system acts on a first side 181 of the actuation piston 18, and a second side 182 thereof pushes against the yoke 16 and the spring and button assembly 17 to pivot the yoke. As the yoke 16 pivots to change its inclination angle, the second side 182 of the actuation piston 18 rubs against the yoke. While the velocity of the movement between the actuation piston 18 and the yoke 16 is relatively low, the pressure is high so that even the very small velocity movements can result in significant wear. The actuation piston 18 pushes against a tab 161 formed on the yoke 16, as shown in FIG. 8. As the tab 161 becomes worn, the yoke 16 may not be inclined properly and the pump 10 may not work efficiently. Eventually, tab 161 could become so worn as to completely fail.

The splines 123 on pump barrel 12 and the tab 161 on yoke 16 have proven to be among the parts of the pump 10 that wear at a rate faster than other parts. When any single component of the pump 10 becomes too worn and the pump ceases to work properly, it may be necessary to take the pump out of service. While some components of the pump 10 may be worn, a large portion of the remaining components of pump 10 may still be in good condition. Thus, it may be desirable to remanufacture pump 10 for cost savings by replacing components that are worn, such as pump barrel 12 and yoke 16. Or pump barrel 12 and yoke 16 may be salvaged for additional cost savings by bringing them back into compliance with their original specifications.

Remanufacturing of Pump Barrel

The problem of worn splines 123 on pump barrel 12 can be overcome by replacing or rebuilding splines 123 with new splines. One method of replacing splines 123 is described below.

Figure 5:
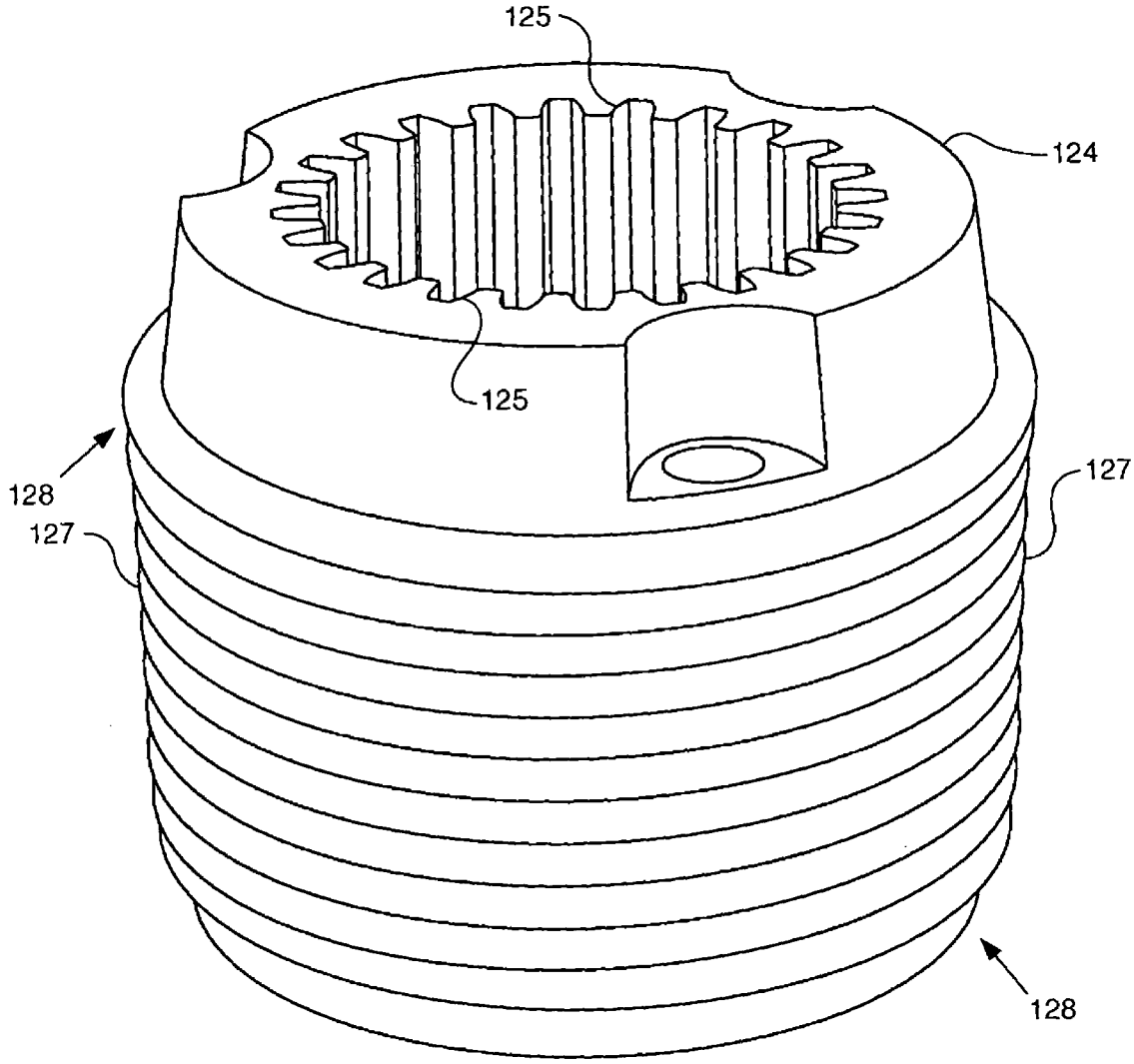
FIG. 5 is an isometric view of a spline insert adapted for the pump barrel of the pump of FIG. 1.
Figure 6:
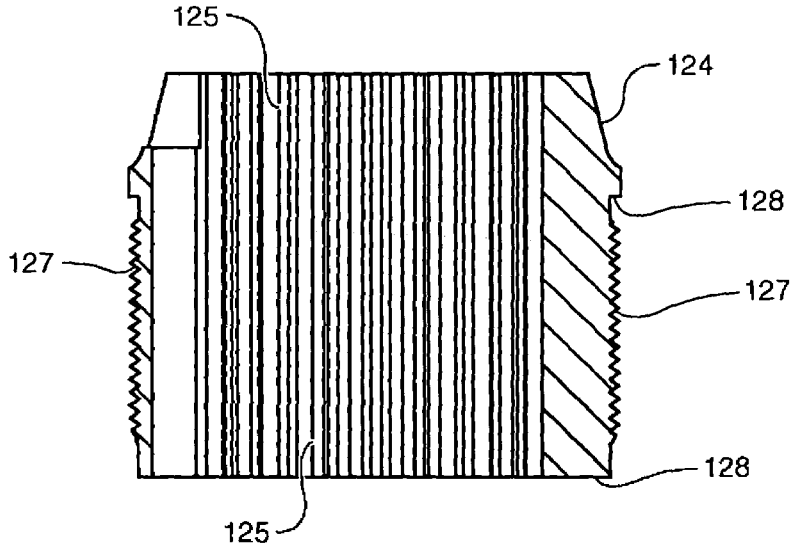
FIG. 6 is a sectional assembly view of the spline insert of FIG. 5 being inserted into the pump barrel of the pump of FIG. 1.
Figure 6:
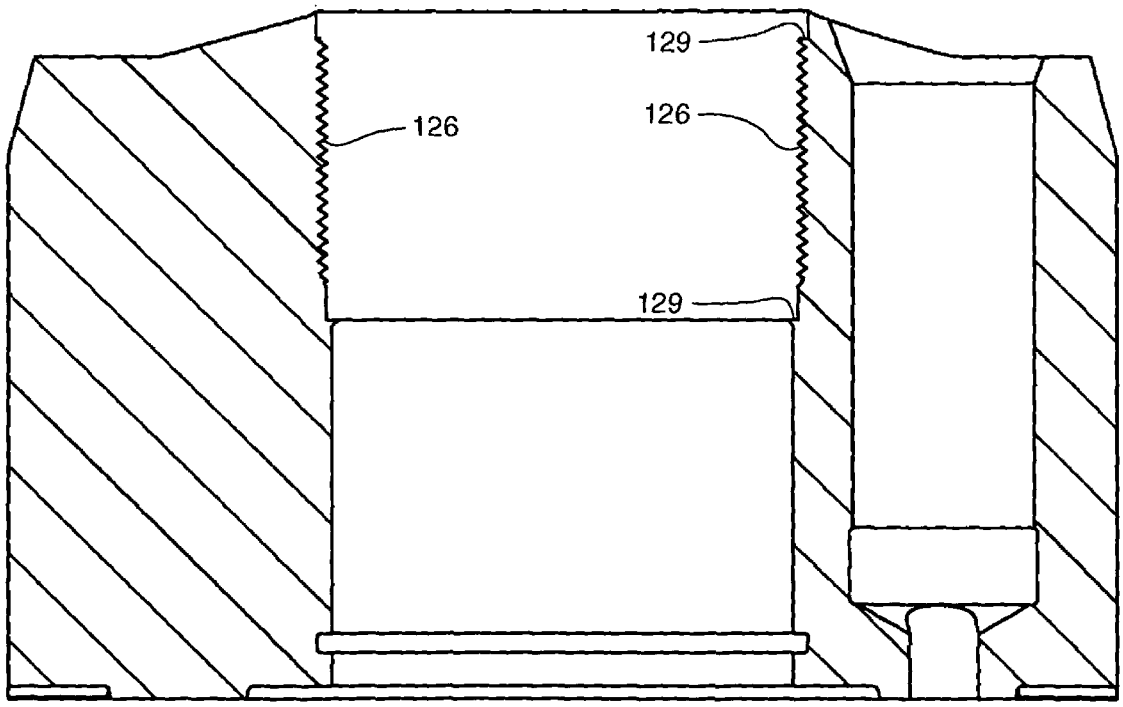
Figure 7:
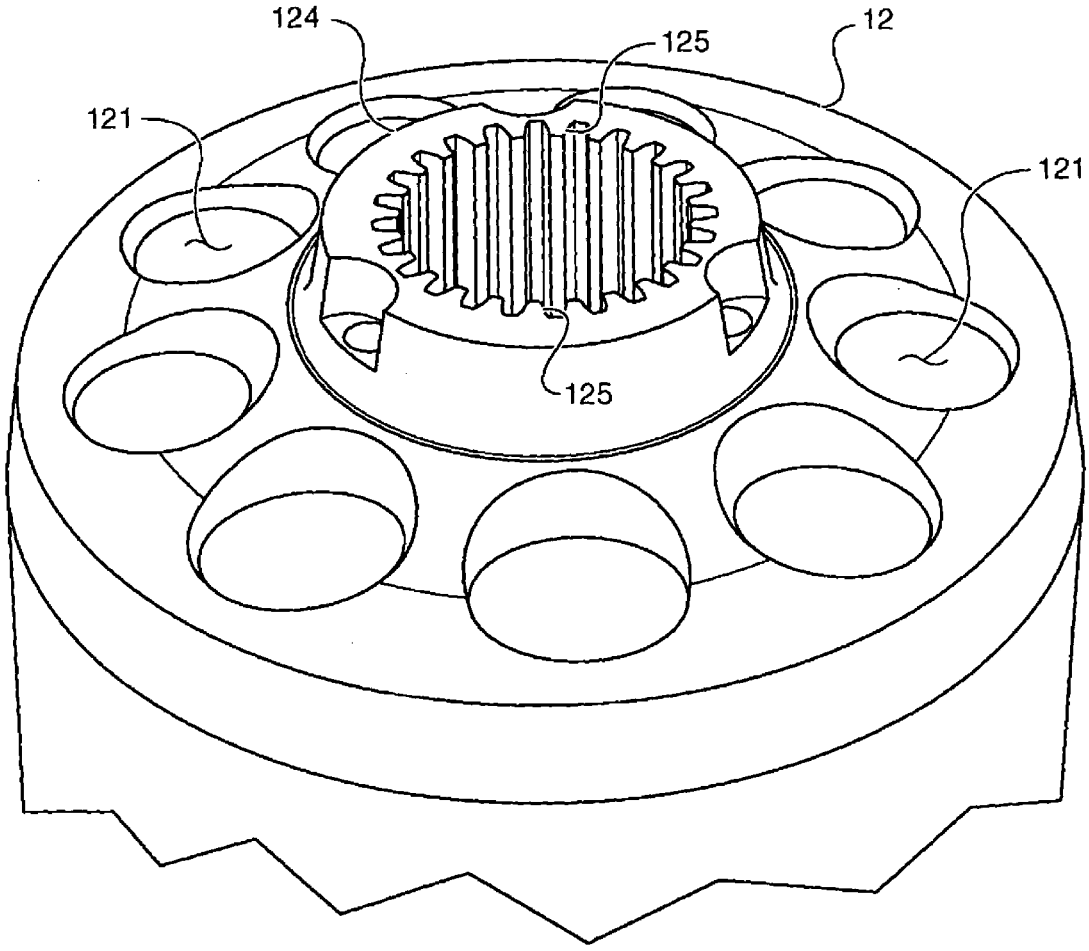
FIG. 7 is an isometric view of the spline insert of FIG. 5 assembled into the pump barrel of the pump of FIG. 1.

To replace or rebuild worn splines 123, the splines are first machined away by a mill or lathe. The splines 123 are removed by machining and enlarging the size of central opening 122. A spline insert 124, shown in FIGS. 5-7, may be formed for inserting into central opening 122 and providing new splines. The spline insert 124 may be annular or tubular in shape, and provide new, internal splines 125 on the interior thereof. New splines 125 are sized to correspond to splines 151 on shaft 15 and to transfer driving power to the pump barrel 12. Spline insert 124 must engage the pump barrel 12 in a way which ensures torque from shaft 15 will be transferred by the spline insert 124 to the pump barrel 12. One successful strategy for providing this engagement and transfer of power has been identified as mating threads on the spline insert 124 and the pump barrel 12. FIGS. 5-6 illustrate the mating threads. Central opening 122 of the pump barrel 12 may be provided with internal threads 126. The spline insert 124 may be provided with corresponding external threads 127. The direction of threads 126, 127 corresponds to the direction of rotation of pump barrel 12. Abutting shoulders 128, 129 are provided on the spline insert 124 and the pump barrel 12, respectively, so that after the spline insert 124 is threaded into pump barrel 12, the connection can tightened to a predetermined torque. FIG. 7 shows the spline insert 124 completely threaded into and engaged with the pump barrel 12. The connection between the spline insert 124 and the pump barrel 12 could also be accomplished in other ways such as a press fit, or a keyway and key. However, threads have been found to be particularly advantageous because they do not cause distortion of the pump barrel 12 as a press fit may, and because the connection is more secure with less stress than a keyway and key.

The use of spline insert 124 to repair the worn splines 123 on the pump barrel 12 has several advantages. The spline insert 124 is relatively inexpensive to manufacture. Spline insert 124 is small so it can be stocked in a small amount of space to await pump cores. Its size also facilitates effective heat treating. Appropriate heat treating procedures, such as case hardening, can extend the life of splines 125. Because of the size of spline insert 124, the appropriate heat treating steps can be completed inexpensively, and the heat treating can penetrate deep into the part. Spline insert 124 allows for the splines 124 to be made from a material different from the rest of pump barrel 12. The material used in spline insert 124 may be more heat treatable than the material used in pump barrel 12. The difference in materials can allow for a finer tuning or properties and characteristics better suited for each environment.

An effective process for replacing the splines 123 has been found to include the following steps: a) mill the worn splines 123 out of pump barrel 12, b) machining new threads 126 in the interior of pump barrel 12, c) screwing and tightening the heat-treated spline insert 124 into pump barrel 12, and d) final machining of the top surface of the spline insert 124. The final machining of the top surface of the spline insert may be desirable to bring the overall length of the pump barrel 12 and spline insert 124 assembly into compliance with the original specifications, and to make the surface perpendicular to the rotational axis A1 of the pump barrel.

A separate pump barrel 12 and spline insert 124 may even be an advantageous design for original manufacturing of pump 10. The two-part design permits spline insert 124 to be made from a desirable material so splines 125 can be effectively heat treated, while the remainder of the pump barrel 12 can be manufactured from a different material more suitable to its purpose.

However, the original manufacturing of the pump barrel 12 in two parts may be too expensive to be cost efficient. An effective life cycle for pump barrel 12 may be to a) originally manufacture it as one solid part with integral splines 123, b) use the pump 10 in service, c) receive the part back from service as a core, d) if the pump merits remanufacturing, replacing the splines 123 with a spline insert 124 and new splines 125, and e) use the pump in service a second time. If the pump 10 fails again or becomes overly worn in service, the insert 124 can be removed by unscrewing it, and a new insert 124 provided. This may be an effective life cycle for efficiently using resources such as materials, labor, and energy.

By effectively replacing splines 123, pump barrel 12 can be salvaged and the majority of the investment in creating an original pump barrel 12 is saved. Replacing splines 123 with a spline insert 124 having new splines 125 can cost approximately 40% of the cost of a new pump barrel 12. The cost savings alone make salvaging the pump barrel 10 beneficial. In addition to the cost savings, as discussed above, a separate spline insert 124 can actually result in splines 125 being more durable than splines 123.

Remanufacturing of Yoke

The problem of a worn tab 161, shown in FIG. 8, can be overcome by replacing or rebuilding the tab. One method of replacing or rebuilding tab 161 is described below.

Figure 9:
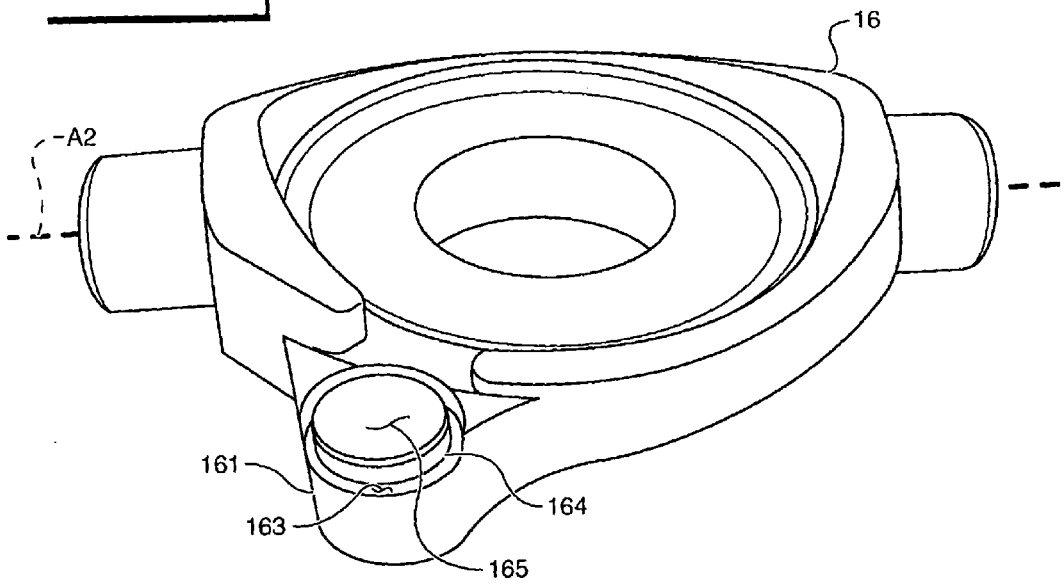
FIG. 9 is an isometric, sketch view of the yoke of FIG. 8 after the worn tab has been repaired with a tab wear button.
Figure 10:
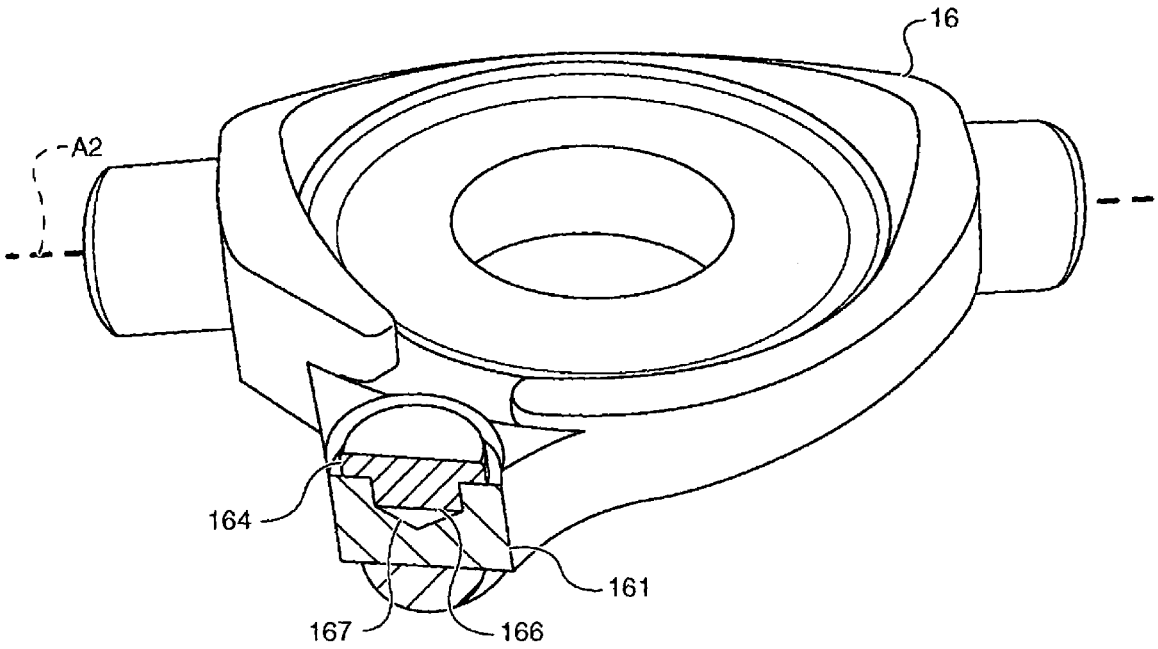
FIG. 10 is an isometric, sketch view of the yoke of FIG. 8 with a portion cut away to show the press fit attachment structure.

To replace or rebuild tab 161, the top surface 162 is first machined down to a new top surface 163 shown in FIG. 9. This can be done, for example, with a mill on a milling machine. A tab button 164 can then be attached to new top surface 163 to provide a surface at the correct location to engage actuating piston 18. Tab button 164 can be attached to tab 161 by welding, brazing, or other similar processes. Or, as shown in FIG. 10, tab button 164 may be attached to tab 161 by forming a projection 166 on either the tab button 164 or the tab 161 which is press fit into a bore 167 in the other of the tab button or the tab. Tab button 164 is sized so that when it is attached to yoke 16, the top surface 165 is coplanar with the original top surface 162 of tab 161, thus bringing this feature of the yoke 16 back to its original specification.

Tab button 164 can be manufactured from a steel that is well adapted for the kind of abrading wear it will experience from the actuating piston 18. Tab button 164 can also be manufactured from a steel that is amenable to a heat treating process that will enhance its wear properties for this environment.

By effectively rebuilding tab 161, yoke 16 can be salvaged and the majority of the investment in creating an original yoke 16 is saved. Rebuilding tab 161 of yoke 16 with tab button 164 as described above can cost approximately 15% of the cost of a new yoke 16. The cost savings alone make salvaging yoke 16 by replacing tab 161 beneficial. In addition to the cost savings, tab button 164 can actually be made more wear resistant than the original tab 161.

For this reason, it may be advantageous to manufacture yoke 16 originally with tab button 164. This would permit the bulk of the yoke 16 to be made from a material well suited for that purpose, while tab button 164 can be made from a material better suited for its environment of abrasive wear.

However, the original manufacturing of yoke 16 with tab button 164 may be cost prohibitive. For this reason, an effective life cycle for yoke 16 may be to a) manufacture it first as a single-piece part with an integral tab 161 as shown in FIG. 8, b) place it in service in a pump 10, c) receive the pump 10 back as a core, d) if yoke 16 merits salvaging, rebuilding tab 161 with tab button 164, and e) placing the pump 10 back in service.

What is claimed is:

1. A method of salvaging an axial piston hydraulic pump, the hydraulic pump comprising a barrel which rotates around a rotational axis, a central bore formed in the barrel generally parallel to the rotational axis, and worn splines formed on an internal surface of the central bore adapted for engaging corresponding external splines formed on a drive shaft, the method comprising:

machining a new central bore in the barrel that substantially removes the worn splines;

forming internal threads on an internal surface of the new central bore;

providing an insert, the insert having:

a second central bore having internal splines formed on an internal surface of the second central bore, the internal splines adapted for engaging the external splines formed on the drive shaft, and external threads formed on an external surface of the insert; and inserting the insert into the new central bore, wherein inserting the insert into the new central bore includes engaging the internal threads on the new central bore with the external threads on the insert.

2. A method according to claim 1 wherein the axial piston hydraulic pump is a variable displacement pump and further comprises a yoke positioned adjacent the barrel, the yoke pivoting about an axis generally normal to the rotational axis of the barrel, the inclination angle of the yoke determining the displacement of the pump, an actuator pushing against the yoke to adjust its angle of inclination, the method further comprising:

attaching a wear button to the yoke, wherein the actuator pushes against the wear button to adjust the angle of inclination of the yoke.

3. A method according to claim 2 further comprising:

providing a projection on one of the wear button or the yoke, providing a bore on the other of the wear button or the yoke; and wherein attaching the wear button to the yoke further comprises inserting the projection into the bore with a press fit.

4. A method according to claim 1 further comprising:

forming a first shoulder on the barrel sized to abut a second shoulder formed on the insert; and wherein inserting the insert into the new central bore further comprises engaging the internal and external threads until the first shoulder abuts the second shoulder.

5. A method of salvaging an axial piston hydraulic pump, the hydraulic pump comprising a barrel configured to rotate around a rotational axis, the barrel including a first central bore around the rotational axis, and first splines on an internal surface of the first central bore configured to engage second splines on a drive shaft, the method comprising:

machining the internal surface of the first central bore to remove the first splines;

forming internal threads on the internal surface of the first central bore after machining;

inserting an insert into the first central bore after machining, the insert having:

external threads on an external surface of the insert; and a second central bore with third splines formed on an internal surface of the second central bore, the third splines being configured to engage the second splines on the drive shaft; and securing the insert to the internal surface of the first central bore by engaging the internal threads with the external threads.

6. The method according to claim 5, wherein the first central bore defines a passage between two end faces of the barrel.

7. A method of manufacturing and remanufacturing an axial piston hydraulic pump comprising:

manufacturing an axial piston hydraulic pump comprising a barrel which rotates around a rotational axis, a central bore formed in the barrel generally parallel to the rotational axis, and splines formed on an internal surface of the central bore adapted for engaging external splines formed on a drive shaft;

placing the pump in service with an end user;

receiving the pump back from an end user after it has been in service;

remanufacturing the pump, the remanufacturing comprising:

removing the splines formed on the internal surface of the central bore of the barrel, providing internal threads on the central bore of the barrel, providing an insert having:

a second central bore with new splines formed on an internal surface of the second central bore, the new splines adapted for engaging the external splines formed on a drive shaft, and external threads on an external surface on the insert; and inserting the insert into the central bore of the barrel, wherein inserting the insert includes engaging the internal threads with the external threads.

8. A method according to claim 7 wherein:

manufacturing an axial piston hydraulic pump further comprises providing a yoke positioned adjacent the barrel, the yoke pivoting about an axis generally normal to the rotational axis of the barrel, the inclination angle of the yoke determining the displacement of the pump, an actuator pushing against the yoke to adjust its angle of inclination; and remanufacturing the pump further comprises attaching a wear button to the yoke, wherein the actuator pushes against the wear button to adjust the angle of inclination of the yoke.

* * * * *

UNITED STATES PATENT AND TRADEMARK OFFICE

CERTIFICATE OF CORRECTION

PATENT NO. : 7,934,303 B2
APPLICATION NO. : 11/148829
DATED : May 3, 2011
INVENTOR(S) : Awwad et al.

It is certified that error appears in the above-identified patent and that said Letters Patent is hereby corrected as shown below:

Title Page, Column 2, Item 74, (Attorney, Agent, or Firm), lines 1-2, delete "Finnegan, Henderson, Farabow, Garrett & Dunner LLP" and insert -- Finnegan, Henderson, Farabow, Garrett & Dunner LLP; Andrew J. Ririe --.

In the Specification

Column 3, lines 24-32, delete "Fluid is supplied to the pump 10 from an inlet 11, drawn into the cylinders of a pump barrel 12, and pushed out of the pump barrel 12 under pressure by pistons 13. The pressurized fluid leaves the pump 10 at outlet 14.
Pump barrel 12 includes a plurality of cylinders 121. A piston 13 is received inside of each cylinder 121. A shaft 15 engages the pump barrel 12 at a central opening 122. The shaft 15 rotates the pump barrel 12 and its associated rotating group around an axis of rotation A1." and
insert -- Fluid is supplied to the pump 10 from an inlet 11, drawn into the cylinders of a pump barrel 12, and pushed out of the pump barrel 12 under pressure by pistons 13. The pressurized fluid leaves the pump 10 at outlet 14. Pump barrel 12 includes a plurality of cylinders 121. A piston 13 is received inside of each cylinder 121. A shaft 15 engages the pump barrel 12 at a central opening 122. The shaft 15 rotates the pump barrel 12 and its associated rotating group around an axis of rotation A1. --.

Column 3, line 40, delete "Al" and insert -- A1 --.

Signed and Sealed this
Twenty-first Day of July, 2015

Michelle K. Lee

Michelle K. Lee
*Director of the United States Patent and Trademark Office*